US005584594A

United States Patent [19]

Newville

[11] Patent Number: 5,584,594

[45] Date of Patent: Dec. 17, 1996

[54] FLOW-THROUGH WASHING AND SCRUBBING BRUSH HANDLE

[76] Inventor: Duane H. Newville, 6242 3rd Ave. South, St. Petersburg, Fla. 33707

[21] Appl. No.: 209,939

[22] Filed: Mar. 11, 1994

Related U.S. Application Data

[62] Division of Ser. No. 2,652, Jan. 11, 1993, Pat. No. 5,336, 012.

[51] Int. Cl.[6] ..... A46B 11/06

[52] U.S. Cl. ..... 401/289; 239/532; 285/302

[58] Field of Search ..... 401/289; 239/165, 239/587.1, 532; 285/302, 165, 178; 403/351

[56] References Cited

U.S. PATENT DOCUMENTS

| | | | |
|---|---|---|---|
| 1,142,439 | 6/1915 | Kosinski | 401/281 |
| 3,244,424 | 4/1966 | Cope | 285/165 X |
| 3,419,293 | 12/1968 | Conrad | 285/302 X |
| 3,447,821 | 6/1969 | Bochory | 285/178 |
| 4,419,026 | 12/1983 | Leto | 403/351 X |
| 4,632,597 | 12/1986 | Clausen et al. | 401/351 |
| 4,652,024 | 3/1987 | Krohn | 239/165 X |
| 4,659,125 | 4/1987 | Chuan | 401/351 X |
| 5,316,264 | 5/1994 | Newman | 251/150 |

*Primary Examiner*—Steven A. Bratlie

*Attorney, Agent, or Firm*—Joseph C. Mason, Jr.; Louise A. Foutch; Mason & Associates, P.A.

[57] ABSTRACT

An improved flow-through washing and scrubbing brush handle for interconnection at one end to a source of pressurized water such as a garden hose and connectable at the other end to flow-through type scrub brush or the like. The device may include structure for varying water flow therethrough for delivery into the scrub brush and further includes a telescoping structure which releasably secures a selected overall length between its sliding inner and outer tubes. Unique sealing arrangements also prevent water leakage anywhere along the device, including from between inner and outer tubes.

2 Claims, 2 Drawing Sheets

FLOW-THROUGH WASHING AND SCRUBBING BRUSH HANDLE

This is a divisional of application Ser. No. 08/002,652 filed on Jan. 11, 1993, now U.S. Pat. No. 5,336,012.

BACKGROUND OF INVENTION

1. Field of the Invention

This invention relates generally to cleaning and washing devices, and more particularly to a telescopic washing and scrubbing brush handle.

2. Description of the Prior Art

The use of flow-through handles or wands for washing and scrubbing automobiles, campers and other vehicles, boats, aluminum siding and windows and the like is well known. Nonflow-through handles are equally well-known. Typically, these devices include a coupling or connector at a first end which is connectable to a source of pressurized water such as a garden hose and connectable at a second end thereof to a flow-through or nonflow-through type scrubbing brush; the former type transfers water through the brush structure and bristles onto the surface to be cleaned, whereas the nonflow-through type does not. The benefits of continuously applying water at the cleaning surface to both accelerate the cleaning process and rinse debris away and to reduce abrasion to the cleaning surface is also well known.

Rotationally actuated cam locking devices for locking telescopic handles into differing functional positions of adjustment are also well known. However, most of the known devices allow adjustment of the overall length of the handle when the cam locking device is in a neutral position, and relative rotation of the tubular parts of the handle in either direction locks said tubular parts together. A cam locking device for a flow-through brush that locks when a first tubular part is rotated in a first direction relative to a second tubular part but which freewheels when rotated in a second, opposite direction does not appear in the prior art.

Another desirable design feature in the flow-through designs is the ability to vary the water flow though the device, including the ability to quickly interrupt water flow to prevent water waste. Various shut-off devices for garden hose arrangements are also well known.

Perhaps the least desireable feature of known prior art devices is the water leakage that occurs during use both at the garden hose coupling end of the device and at the mid portion thereof where the outer tube overlaps the inner tube to enable the telescoping feature. Although the user may anticipate some water contact during a car washing procedure, nonetheless the presently existing degree of water leakage through the known devices is so excessive as to impose a serious limitation on the overall usefulness of said devices.

SUMMARY OF INVENTION

The present invention provides a flow-through washing and scrubbing handle which affords all of the above design features while eliminating virtually all water leakage along the entire length of the device so that all pressurized water which exits the garden hose into the device is transmitted into and through the flow-through brush head itself without leakage. The present invention also provides a cam lock device that locks the telescoping tubes with respect to one another when rotated in a first direction and which freewheels, i.e., does not lock said tubes, when rotated in a second direction opposite to said first direction. The novel cam lock device has utility in connection with flow-through as well as nonflow-through handles; said device has a water passageway in its flow-through configuration and lacks such passageway in its nonflow-through configuration.

More particularly, the invention is directed to an improved washing and scrubbing brush handle adapted for interconnection at one end to a source of pressurized water such as a garden hose and connectable at the other end to a flow-through or nonflow-through type scrub brush or the like. The device may include structure for varying water flow therethrough for delivery into the scrub brush and further includes a telescoping structure which releasably secures a selected overall length between its sliding inner and outer tubes.

Unique sealing arrangements also prevent water leakage anywhere along the device, including between inner and outer tubes.

It is therefore an object of this invention to provide a telescopic flow-through washing and scrubbing brush handle for delivering water from a pressurized water source such as a garden hose into a flow-through scrubbing brush head or the like.

It is yet another object of this invention to provide a leakage free telescopic flow-through washing and scrubbing brush handle.

It is yet another object of this invention to provide a leakage free telescopic flow-through washing and scrubbing brush handle which controls the flow rate of water therethrough without leakage.

Another object is to provide a cam lock device for a flow-through brush that locks the telescoping tube in a preselected position of adjustment when a first tube is rotated a first direction relative to a second tube and which freewheels without locking said tubes when said first tube is rotated in a second direction opposite to the first.

In accordance with these and other objects which will become apparent hereinafter, the instant invention will now be described with reference to the accompanying drawings.

DETAILED DESCRIPTION OF THE PREFERRED EMBODIMENT

Figure 1:
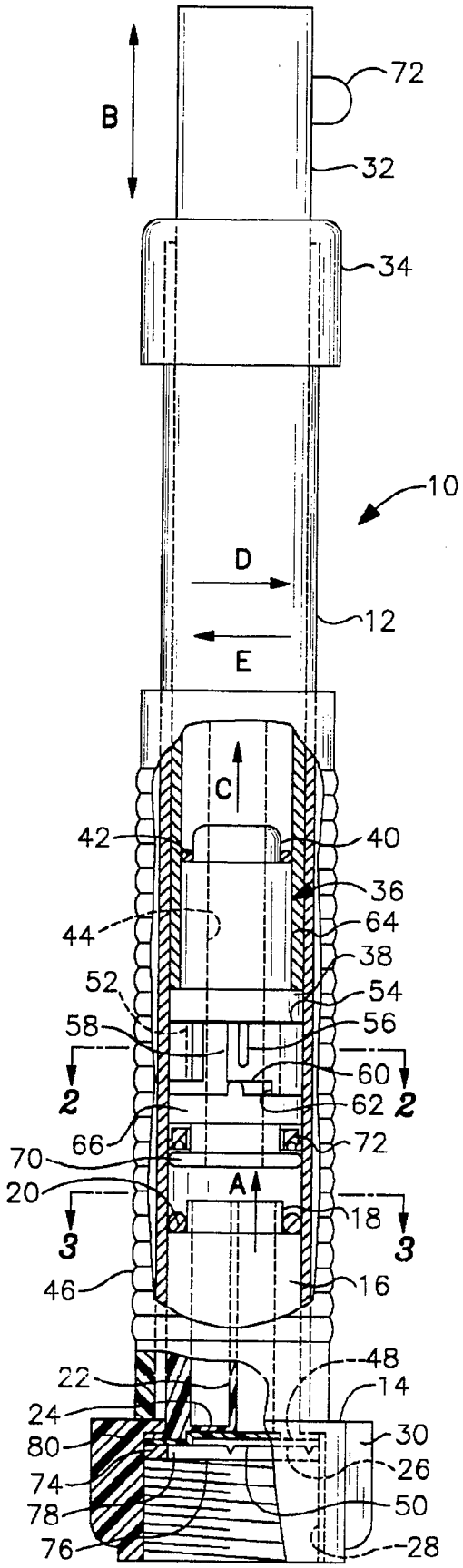
FIG. 1 is a side elevation broken section view of the invention.

Referring now to the drawings, an illustrative embodiment of the invention is shown generally at numeral 10 in FIG. 1 and includes an elongated drawn aluminum outer tube 12 slidably engagable over a drawn aluminum inner tube 32. Although extruded rolled tubing stock is acceptable, it is preferred to use drawn aluminum as the dimensional tolerances are more closely held and the strength properties of the aluminum are significantly increased. The outer surface of the inner and outer tubes 32 and 12 are also anodized for additional appearance and corrosion protection.

An end cap 34, formed of molded resilient plastic and fitted over one end of the outer tube 12, serves as a travel stop and sleeve guide to prevent the inner tube 32 from separating from the outer tube 12 and to also provide a bearing surface between the two tubes 12 and 32. The distal end of the inner tube 32 includes a depressible locking pin 72 which is engagable into a flow-through or nonflow-through type scrubbing and cleaning brush (not shown) in a well known manner.

The free end of the outer tube 12 includes a tubular gripping handle 46 secured therearound formed of molded resilient plastic material for convenient gripping and also includes a rotatable coupling 14. This coupling 14 includes an internal longitudinal thread 28 which is matably engagable onto a threaded end fitting of a garden hose (not shown). Coupling 14 also includes integral molded radially extending tightening flanges 30 to facilitate a more secure connection onto the end of the garden hose.

A plastic molded water control valve 16 is also fitted into the free end of the outer tube 12. Valve 16 has an enlarged lower flange 80 molded into one end to abuttingly engage an annular shoulder defined by internal threaded portion 28 of coupling 14. A longitudinal partition 22 is molded lengthwise through the otherwise hollow interior of control valve 16 and one half of said hollow control valve interior is closed off at its lower end by an end partition 24. Control valve 16 is inserted into the free end of the outer tube 14 and rigidly secured thereto by staking or otherwise point deforming the outer tube 12 to mechanically engage said control valve 16.

Figure 3:
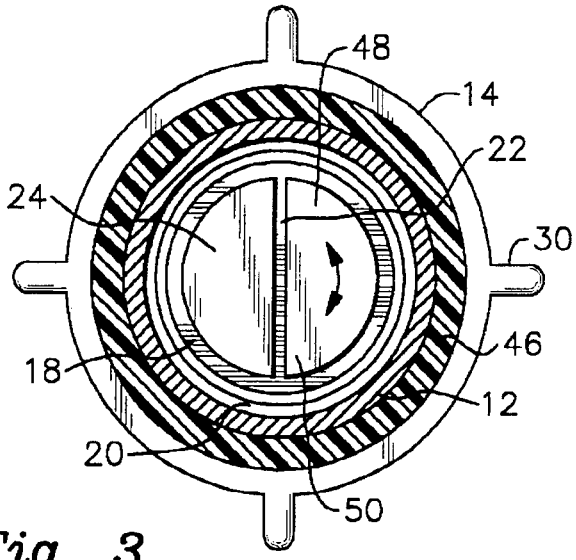
FIG. 3 is a section view in the direction of arrows 3—3 in FIG. 1.

Rotatable flow control disc 50 abuts flange 80 and includes a flow aperture 48 formed therethrough. Flow aperture 48 is sized to mate and align with the open portion of the control valve 16 so that water flows through the control valve 16 in the direction of arrow A. However, when the disc 50 is rotated back and forth in the direction of arrow F (FIG. 3) to either partially or fully misalign with the open half of the control valve 16 to thereby partially or fully enter into alignment with end partition 24, the water flow in the direction of arrow A is either diminished or stopped altogether.

A conventional rubber sealing grommet 76 having central hole 78 therethrough is fitted against control disc 50 in a well-known manner. Prongs 74 are integrally formed with disc 50, and depend therefrom; said prongs engage rubber grommet 78 to ensure conjoint rotation of coupling 14 and disc 50.

Water flowing in the direction indicated by directional arrow A is sealed against reverse direction flow by rubber O-ring 20 which is seated around reduced diameter groove 18 of control valve 16.

A twist lock body or cam lock device is shown generally at 36 and structurally facilitates both the locking engagement between the inner and outer tubes 32 and 12, respectively, and also prevents any water leakage between the inner and outer tubes 32 and 12 in flow-through models; it provides no leakage-preventing function in nonflow-through models, of course. Cam lock device 36 is integrally molded of plastic and includes at its upper end as seen in FIG. 1 a reduced diameter end groove 40 sized to receive a rubber O-ring 42 for sealing engagement against the inner wall of the inner tube 32. Cylindrical main body portion 64 is mechanically secured within the inner tube 32 by staking as previously described.

In flow-through models, cam lock device 36 also includes a longitudinal passageway 44 therethrough so that water flowing in the direction of arrow A will flow therethrough in the direction of arrow C into the interior of the inner tube 32 for discharge into a conventional flow-through brush connected at the distal end of the inner tube 32 (not shown) as previously described. Shoulder 38 limits insertion of cam lock device 36 into inner tube 32.

A sealing groove is formed adjacent the lower shoulder end 70 of the cam lock device 36 to receive a one-way packing seal 72 such as provided by Parker Seals of Salt Lake City, Utah, Series 8500. Seal 72 prevents water flowing into the interior of the outer tube 12 in the direction of arrow A from escaping or leaking therearound. Absent seal 72, the pressurized water would leak out from between the inner and outer tubes 32 and 12, respectively.

Figure 2:
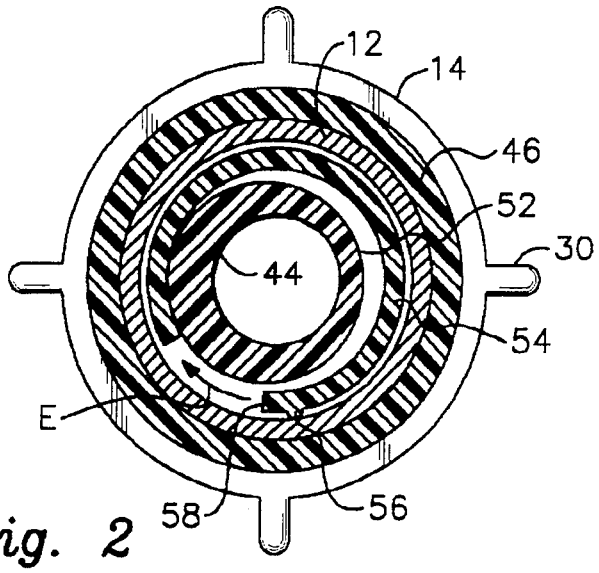
FIG. 2 is a section view in the direction of arrows 2—2 FIG. 1.

Cam lock device 36 also includes an eccentric or off-center cam surface 52 as best seen in FIG. 2, loosely mounted around which is a plastic locking collar 54. Note in FIGS. 1 and 2 that said locking collar is "C" shaped and has a first pair of opposed ends circumferentially spaced apart from one another by a first predetermined distance. Note further in FIG. 1 that said locking collar has a second pair of opposed ends, one of which is denoted 62, that are circumferentially spaced apart from one another by a second distance greater than said first distance. The locking collar 54 includes bump or protrusion 56 or other suitable eccentricity adjacent its longitudinal end surface 58 so that, when the locking collar is rotated in the direction of arrow D (FIG. 1), a wedging effect between the interior surface of the outer tube 12 and eccentric surface 52 is effected. By this arrangement, a secure, yet releasable locking engagement is effected between the inner and the outer tube 32 and 12, respectively, at any preselected arranged telescopic length in the direction of double-headed arrow B. Stop surface 62 formed into the lower end of the locking collar 54 serves to prevent over-rotation in the direction of arrow E against protrusion 60 of the twist-lock body 36.

Figure 4:
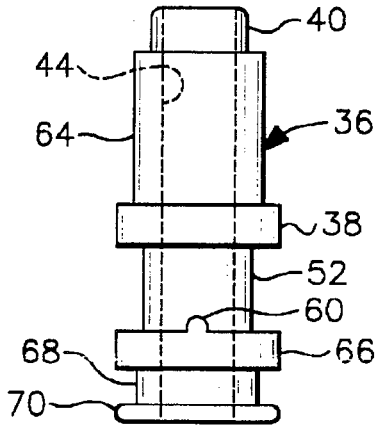
FIG. 4 is a side elevation view of the integral twist lock body shown in FIG. 1.

More particularly, as inherently explained in FIGS. 1, 2, and 4, relative rotation between tubes 12 and 32 in the direction indicated by directional arrow E in FIGS. 1 and 2 causes one of the two stop surfaces 62 to abut protrusion 60 and thus effect conjoint rotation between said stop surface and said cam lock device. Accordingly, locking collar 54 free wheels as such relative rotation continues, i.e., tubes 12 and 32 will not lock together. For this reason, the indicia "LOCK" and "UNLOCK" and associated directional arrows are provided on device 10 as indicated in FIG. 1. This unique feature is provided by a double eccentricity built into the novel device; specifically, the eccentricity of cam surface 52 of cam lock device 36 and the eccentricity of locking collar 54. When a stop surface 62 abuts protrusion 60, the eccentricities cancel one another and said parts (cam surface 52 and locking collar 54) are concentric with one another to allow said free wheeling. When the relative rotation between the inner and outer tubes is reversed, i.e., when the tubes are relatively rotated in LOCK direction D, the concentric alignment is lost and the tubes lock with respect to one another.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An improved flow-through washing and scrubbing brush handle, comprising:

an elongated hollow outer tube;

a coupling for connecting a first end of said hollow outer tube to a source of water under pressure;

an elongated rigid hollow inner tube mounted for slidable rotational and longitudinal movement within said outer tube, a first end of said inner tube extendable beyond a second end of said outer tube;

said first end of said inner tube adapted for connection to a flow-through type brush head;

an elongated cam lock device, a first part of said cam lock device connected within a second end of said inner tube positioned within said outer tube;

said cam lock device having a first sealing ring around the end of said first part thereof for preventing water passing into said inner tube through said water passage from passing out of said inner tube second end;

a second sealing ring positioned transversely around an end of a second part of said cam lock device extending into said outer tube beyond said inner tube second end, said second sealing ring structured for preventing pressurized water entering said outer tube first end from passing between said inner and outer tubes; and said cam lock device having a second part eccentrically disposed with respect to said first part;

a C-shaped locking collar loosely positioned around said second part of said cam lock device, said C-shaped locking collar having a first pair of opposed free ends that are circumferentially spaced apart from one another by a first predetermined distance and a second pair of opposed stop surfaces that are circumferentially spaced apart from one another by a second predetermined distance which is greater than said first predetermined distance;

a protrusion formed in said second part of said camlock device;

said locking collar having an eccentricity formed therein;

said eccentricity formed in said locking collar cooperating with said eccentrically disposed second part of said cam lock device to lock said inner and outer tubes into a preselected position of functional adjustment when said tubes are rotated in a first direction relative to one another and to unlock said inner and outer tubes when rotated in a second direction opposite to said first direction, said protrusion abutting one of said stop surfaces and said locking collar free-wheeling conjointly with said cam lock device when said tubes are rotated in said second relative direction so that said inner and outer tubes are not lockable with respect to one another when said tubes are rotated in said second relative direction.

2. An improved flow-through washing and scrubbing brush handle as set forth in claim 1, further comprising:

means connected to said coupling and positioned within said outer tube first end for controlling a rate of flow of water through said outer tube.

* * * * *